United States Patent [19]

Kieres

[11] Patent Number: 4,754,710

[45] Date of Patent: Jul. 5, 1988

[54] RAILWAY CAR FOR CARRYING FREIGHT SUCH AS COAL OR THE LIKE

[76] Inventor: Keith C. Kieres, 726 Scottish Mill Run, Marietta, Ga. 30068

[21] Appl. No.: 881,330

[22] Filed: Jul. 2, 1986

[51] Int. Cl.[4] ..... B61D 3/00; B61D 7/00; B61F 1/00

[52] U.S. Cl. ..... 105/355; 105/404; 105/418

[58] Field of Search ..... 105/3, 4.1, 4 R, 199.5, 105/247, 248, 413, 414, 416, 251, 1.4, 5, 238.1, 239, 355, 396, 404, 409, 463.1, 418; 213/8, 62 A, 62 R

[56] References Cited

U.S. PATENT DOCUMENTS

| | | | |
|---|---|---|---|
| 676,103 | 6/1901 | Souder | 105/248 |
| 2,167,362 | 7/1939 | Hindahl | 105/251 |
| 2,792,791 | 5/1957 | Kreissig | 105/416 |
| 3,557,707 | 1/1971 | Joy | 105/238.1 X |
| 3,659,724 | 5/1972 | Miller et al. | 213/8 |
| 3,687,084 | 8/1972 | O'Leary et al. | 105/4.1 |
| 4,345,523 | 8/1982 | Robertson | 105/1.4 |

FOREIGN PATENT DOCUMENTS

| | | | |
|---|---|---|---|
| 232811 | 9/1944 | Switzerland | 105/355 |

OTHER PUBLICATIONS

*Railway Age,* Jul. 28, 1969, pp. 22–24, 55.

*A Short Course in Corrosion,* Edited by I. Cornet, "Metal Coatings", by A. Mendizza, p. 44, held at the Univ. of California at Berkeley, Feb. 2–6, 1953.

D. E. Newland et al., "Fundamental Design Considerations for Multi-Wheeled Flexible Railway Vehicles", ASME publication, Oct. 1970, 16 pages.

*Primary Examiner*—Robert B. Reeves

*Assistant Examiner*—Scott H. Werny

*Attorney, Agent, or Firm*—Shlesinger, Arkwright & Garvey

[57] ABSTRACT

A railway car having an optimum length of 500 feet comprising two end walls, two side walls and a floor forming one continuous trough. The trough being supported at each end wall by wheel-containing truck means and at an intermittent section by a plurality of wheel containing truck means. The side walls consist of a plurality of side panels. The side panels are provided with overlapping means to permit relative motion between adjacent panels for maneuvering curves and hills. The floor includes a plurality of laterally and longitudinally extending slope sheets. The laterally extending slope sheets are provided with overlapping means to allow relative motion therebetween. A flexible center sill extends continuously the entire length of the railway car.

21 Claims, 3 Drawing Sheets

FIG 5
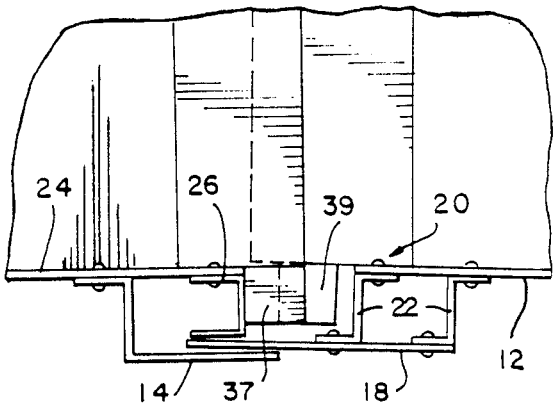
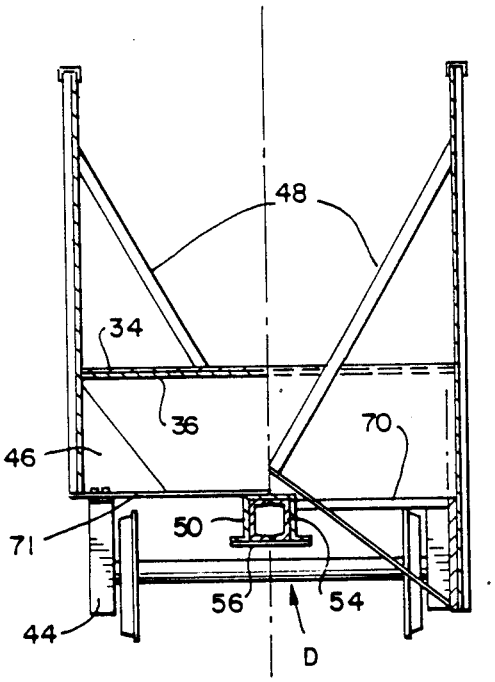
FIG 3
FIG 8
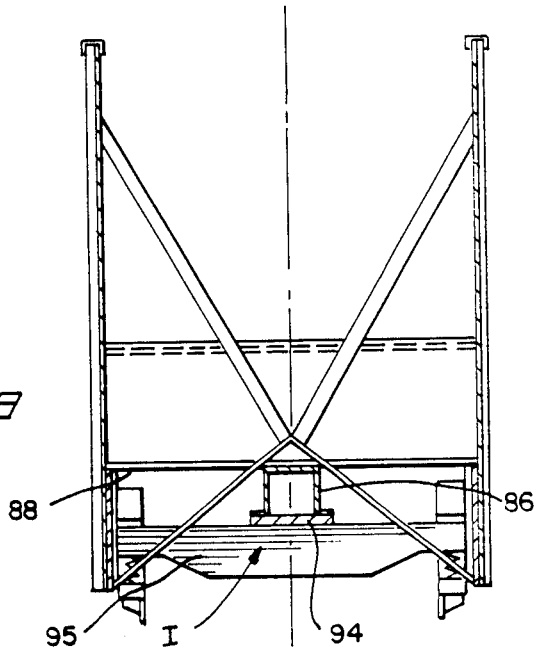
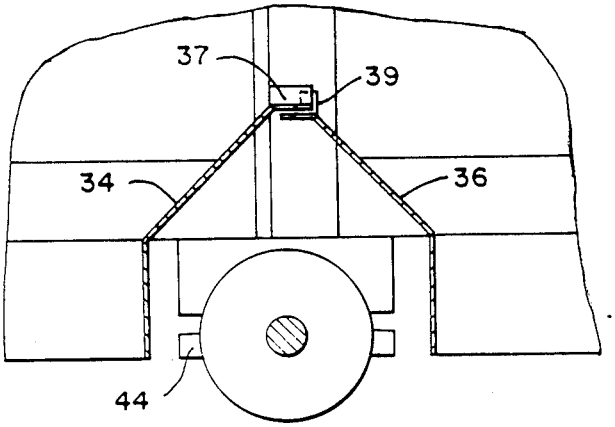
FIG 4

RAILWAY CAR FOR CARRYING FREIGHT SUCH AS COAL OR THE LIKE

FIELD OF THE INVENTION

The present invention pertains to a railway car for carrying bulk commodities such as coal or the like, more specifically a railway car having a length several times that of the standard railway car.

BACKGROUND OF THE INVENTION

The traditional means for transporting freight such as coal or the like across the continental U.S. has been the railway car. The standard railway car for transporting coal includes a car body having two end walls and two side walls, a standard truck positioned at each end of the car body and coupling means for interconnecting the individual cars of a train. The centers of the trucks of coal cars are usually spaced 45 feet apart. The overall car body normally has a length of 50 to 55 feet. Center sills extend longitudinally along the underside of the car body between bolsters supported by the standard trucks. Center sills of this type are disclosed in U.S. Nos. 3,040,679, 3,102,497, 3,538,857, and 4,003,319.

Center sills of the type disclosed in the above patents are rigidly mounted to the railway car. These center sills cannot flex or bend to compensate for curves. Trains using rigid center sills must employ standard truck bolsters and couplings to enable the train to maneuver through curves. The standard couplings and bolsters form a considerable portion of the overall weight of the railway car. Prior to this invention it has not been known to use a flexible center sill for maneuvering curves.

Industry standards have imposed on railway companies maximum weight limits that may be distributed over a set of axles. The weight limit varies according to the specific class or size of the axles. The weight limit includes the weight of the railway car and the weight of the lading allocated to the set of axles. An inherent disadvantage in the use of conventional railway cars is that a significant portion of the weight limit must be allocated for the weight of the railway car. Consequently, the amount of freight which can be hauled is significantly reduced resulting in higher operating costs and diminished profits.

OBJECTS AND SUMMARY OF THE INVENTION

Accordingly, an object of the invention is to provide a railway car that significantly reduces operating costs by maximizing the car's load carrying capacity.

Another object of the invention is to reduce the slack action at the intermediate connection of the railway cars.

Yet another object of the invention is to provide a railway car that significantly reduces the aerodynamic drag on the train.

A further object of the invention is to provide a railway car that can be inexpensively manufactured and maintained.

Another object of the invention is to provide a railway car having single axle trucks uniformly spaced along the trough to greatly decrease the chance of train derailment.

Yet a further object of the invention is to provide a railway car which uniformly distributes the weight of the train to the track structure.

A further object of the invention is to provide a railway car that can be readily loaded and unloaded.

Another object of the invention is to provide a railway car that reduces the angles incurred while maneuvering through curves.

Still a further object of the invention is to provide a railway car that can carry bulk materials such as coal, grain and ores.

A further object of the invention is to provide a train having a greater load carrying capacity than conventional trains of equilvalent length.

Another object of the invention is to maintain conventional train dimensions while increasing load carrying capacity.

Yet another object of the invention is to substantially reduce the weight of the train unloaded.

Still a further object of invention is to provide a mound consisting of slope sheets every twelve to twenty-four feet along the trough to facilitate unloading of the car.

In summary, the present invention provides a railway car having a length several times that of the standard railway car. The present railway car having an optimal length of five hundred feet eliminates intervening end walls and couplings of conventional railway cars necessary for an equivalent trough length. Thus, the instant railway car is considerably lighter than equivalent conventional cars. This aspect of the present invention significantly increases the load carrying capacity of the railway car resulting in lower operating costs and greater profits.

DESCRIPTION OF THE DRAWINGS

FIG. 3 is a cross-sectional view having the left portion taken along lines 3—3 and the right portion taken along lines *3a—3a*.

FIG. 4 is a sectional view of the overlapping slope sheets taken along lines 4—4.

FIG. 5 is an exploded view of the overlapping means.

FIG. 8 is a cross-sectional view taken along lines 8—8 as seen in the direction of the arrows.

DETAILED DESCRIPTION OF THE INVENTION

Figure 1:
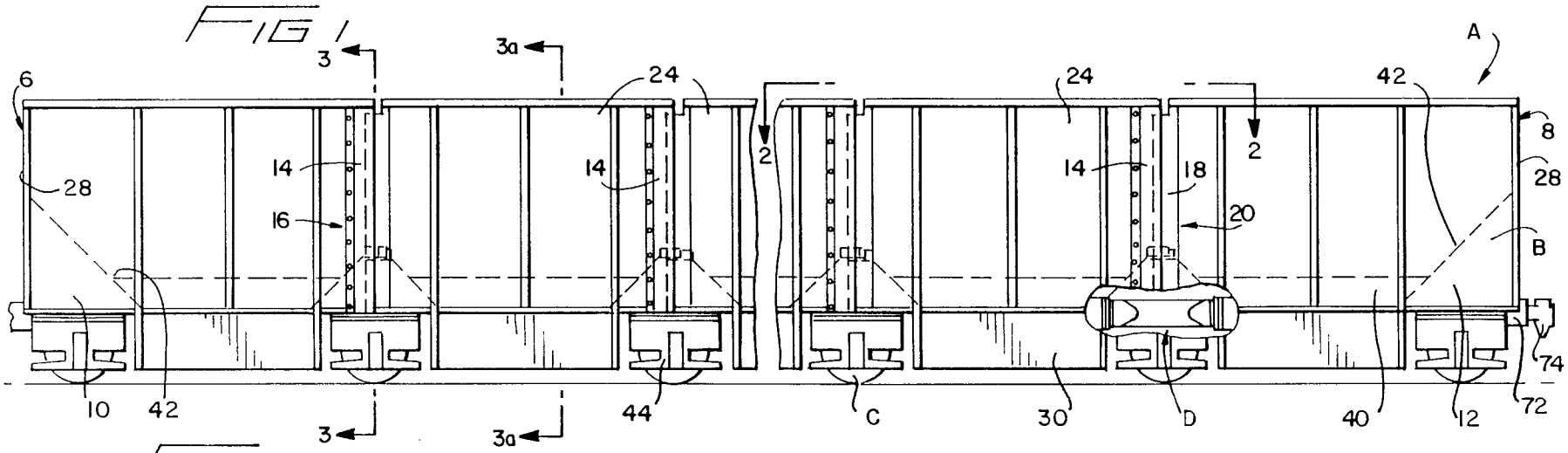
FIG. 1 is a fragmentary elevational view of the railway car.

FIGS. 1, 2, 3, 4 and 5

Railway car A comprises a trough or body section B mounted on a plurality of trucks C and a compound center sill D extending along the entire length of the trough B. Trucks C are uniformly spaced along trough B. The trough B consists of side walls 2 and 4 and end walls 6 and 8. Side wall 2 includes a left end panel 10, abutting end wall 6 and a right end panel 12 abutting end wall 8. Left end panel 10 has a Z-shaped member 14 secured to end 16. End 16 further has a U-shaped member (not shown) secured thereto. The U-shaped member prevents coal from entering the clearance formed between Z-shaped plate 14 and end panel 10. Right end panel 12 has a plate 18 secured to end 20 by substantially S-shaped brackets 22 as best seen in FIG. 5.

A plurality of intermediate panels 24 have plates 18 secured to one end by substantially S-shaped brackets 22. At the other end, intermediate panels 24 have Z-shaped members 14 riveted thereto. U-shaped members 26 are positioned in the clearance formed between Z-shaped member 14 and intermediate panels 24, Z-shaped members 14 overlap plates 18 and allow relative motion between adjacent panels. It will be appreciated by one of ordinary skill in the art that the overlapping means E consisting of Z-shaped members 14, plates 18 and U-shaped members 26 could be secured to the inner side of walls 2 and 4. Further, it would be obvious to provide other means for allowing overlapping of the side panels. The structure of side wall 4 is identical to that of side wall 2 and will not be described in detail. A plurality of angles 28 are mounted on side walls 2 and 4 and end walls 6 and 8.

Doors 30 are provided between signel axle trucks C. Slope sheets 34 and 36 extend laterally across the trough B and are secured at opposite ends to side walls 2 and 4. Slope sheets 34 and 36 are joined at apex 38. Slope sheets 34 and 36 are joined in such a manner as to allow relative motion therebetween. Slope sheets 34 and 36 include angularly extending flanges 37 and 39 respectively (as best shown in FIG. 5). Angularly extending flanges 37 and 39 prevent coal from passing under slope sheets 34 and 36. However, sufficient clearance is provided between flanges 37 and 39 and plate 18 to permit angular movement of the intermediate panels while the railway car A is maneuvering a curve. Slope sheets 40 extend longitudinally along trough B and abut slope sheet 34 and 36. Slope sheets 42 are positioned at each end of the railway car A. The slope sheets 34, 36, 40 and 42 are arranged such that slope sheets 42 extend above slope sheets 34,36 and 40.This arrangement facilitates unloading of the coal or other bulk commodities.

Railway car A is mounted on trucks C through side frames 44. Side frames 44 are each rigidly secured to only one section of the trough B thereby permitting relative motion between adjacent side panels. Support brackets 46 are secured at one end to side walls 2 and 4 and at the other end to side frames 44 (shown in FIG. 3). Support brackets 46 distribute the vertical load to side walls 2 and 4. This arrangement eliminates the need for conventional web sheets and truck bolsters. Thus, the weight of the railway car A is further reduced. Side wall supports 48 extend between slope sheets 40 and side walls 2 and 4 in order to maintain the side walls in an upright position.

Figure 2:
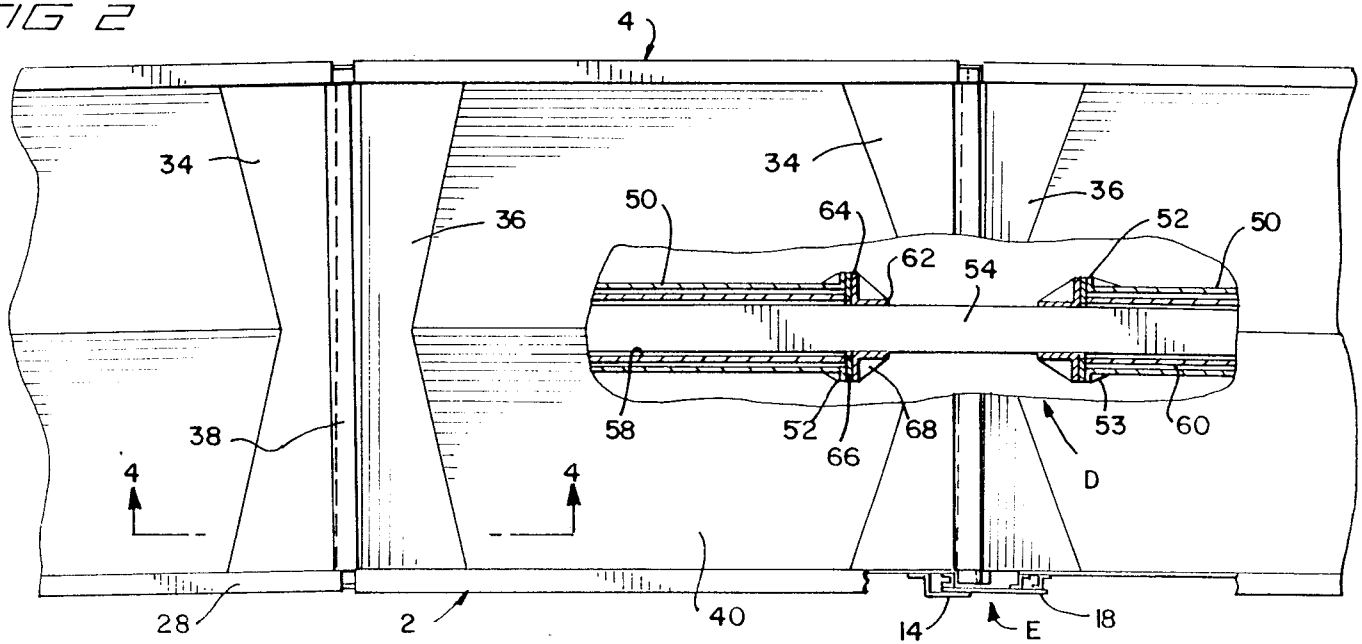
FIG. 2 is a fragmentary sectional plan view of the trough of the railway car taken along lines 2—2.

Compound center sill D (as best shown in FIG. 2) includes a plurality of exterior center sill sections 50 spaced along the underside of trough B having flanges 52 extending outwardly therefrom. A gusset 53 extends at an angle between sections 50 and flanges 52 providing additional support for flange 52. Exterior center sill 50 is formed from aluminum. Exterior center sill 50 supports a steel interior center sill 54 via straps 56. However, it would be well within the knowledge of one of ordinary skill in the art to vary thematerial to meet design needs. The straps 56 run intermittently along the underside of trough B. Interior center sill 54 extends continuously along the entire length of railway car A. A clearance 58 is provided between exterior center sill 50 and interior center sill 54. A non-metallic pad 60 formed from hardened plastic or similar material is positioned in each clearance 58. The non-metallic pad reduces electrolytic corrosion of the compound center sill D.

A backing plate 62 is mounted on interior center sill 54 directly adjacent each flange 52. Stops 64 extend at a right angle from interior center sill 54. A rubber pad 66 is secured to stop 64. A gusset 68 extends at an angle between backing plate 62 and stop 64 providing additional support for stop 64. As seen in FIG. 3, crossbearers 70 are positioned on each side of the compound center sill D for transferring vertical loads to side walls 2 and 4. Crossbearers 70 are secured at one end to exterior center sill 50 and at the other end to an adjacent side wall. A pair of sheer plates 71 are positioned over each truck C for transferring longitudinal loads to the side walls 2 and 4 from exterior center sill sections 50. It will be appreciated by one of ordinary skill in the art that similar load transferring members may be used. Each shear plate 71 is secured to only one section of trough B, therefore, allowing relative motion between adjacent side panels. An adapter 72 is provided at each end of the compound center sill. The adapters 72 form the proper fittings to receive standard couplings 74.

OPERATION OF EMBODIMENT SHOWN IN FIGS. 1-4

The operation of the railway car A will now be described with reference to a train comprising a locomotive and a single railway car. It will be appreciated by one of ordinary skill in the art that additional railway cars can be added. The additional railway cars A will operate in an identical manner.

The drive force of a locomotive is transferred to railway car A through standard couplings 74 and compound center sill D. More particularly, the interior center sill 54 is drivingly connected to a locomotive by adapter 72 and standard couplings 74. Upon forward movement of the locomotive, stop 64 abuts against flanges 52 of exterior center sill 50. Exterior center sill 50 is rigidly secured to railway car A. Therefore, once flanges 52 contact stops 64 the forward motion of the locomotive is transferred to trough B.

Railway car A has a optimal length of 500 feet. Thus, it is necessary to provide means which will allow the railway car to maneuver curves and hills. One feature of the present invention which permits railway car A to maneuver varying terrains is the flexible interior center sill. Rubber stops 64 permit bending of the flexible interior center sill 54 is clearances 58. The flexing of interior center sill 50 in clearances 58 replaces the conventional pivoting motion at the couplings. Further, a clearance (not shown) is provided between side frame 44 and the axle of truck C to allow for steering.

Side wall overlapping members 14 and 18 allow relative movement between adjacent panels to prevent undue stress on side walls 2 and 4. As the railway car enters a turn, the side panels positioned above the inside track will be forced closer together while side panels above the outer track will be forced apart. When the train is passing over a hill, the lower portions of the side panels of side walls 2 and 4 will be forced together while the upper portion of the panels will be forced outward.

Further slope sheets 34 and 36 are able to move relative to one another to compensate for curves and hills in a similar manner as the intermediate side panels 24.

The railway car A, by eliminating the intermittent couplings and end walls necessary for conventional trains having an equivalent trough length, has significantly reduced the weight attributable to the railway car and thereby increased its load carrying capacity.

Figure 6:
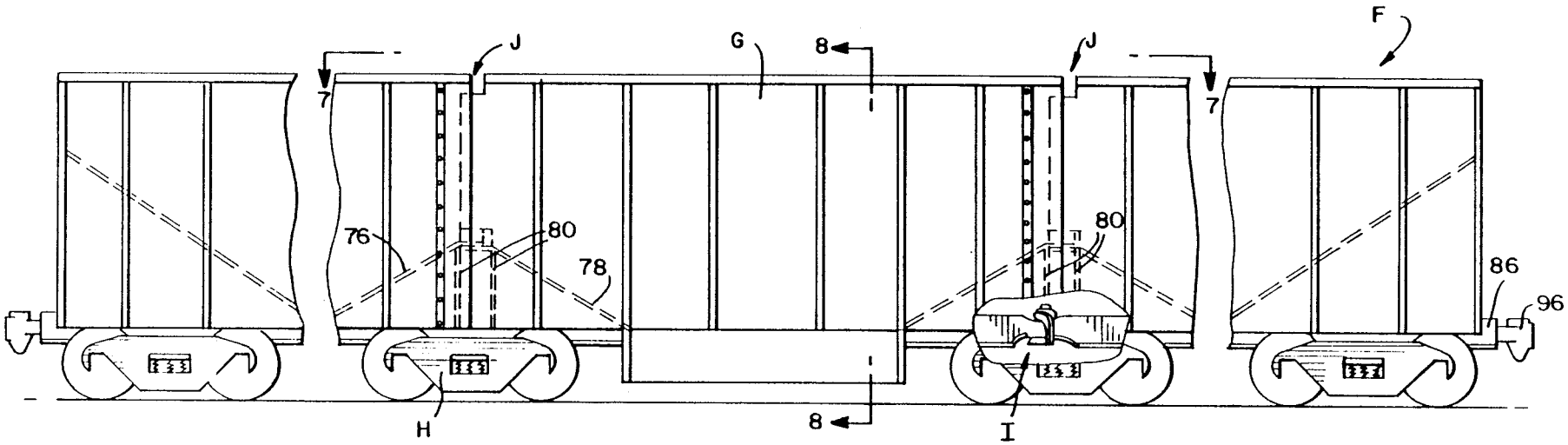
FIG. 6 is a fragmentary elevational view of the second embodiment of the invention.
Figure 7:
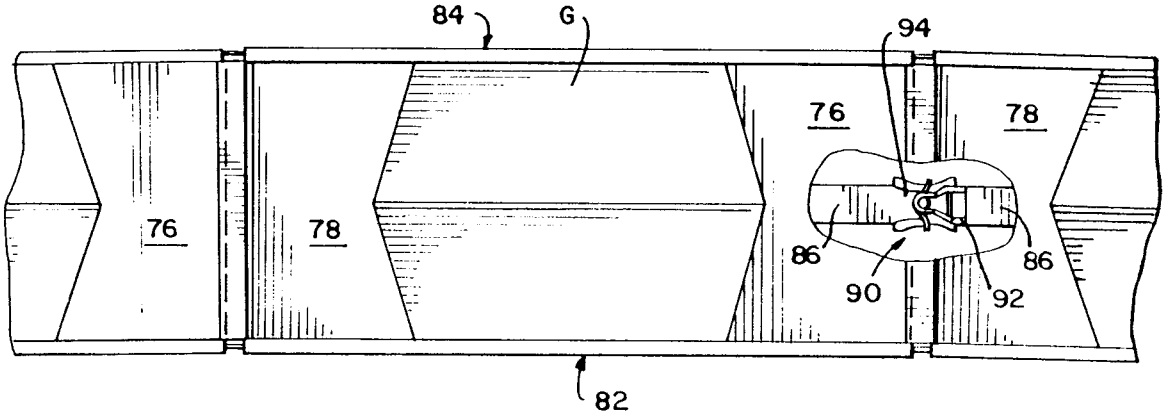
FIG. 7 is a fragmentary sectional plan view of the trough of the second embodiment of the invention taken along lines 7—7.

FIGS. 6, 7 and 8

FIG. 6 illustrates a second embodiment of the invention. Railway car F comprises a trough G mounted on standard trucks H and a center sill I extending along the underside of trough G. The trough G is very similar to trough B disclosed in the first embodiment of the invention. Only the differences will be described in detail.

Trough G, unlike trough B, is supported at the center by sill I. It is, therefore, necessary to provide a pair of laterally extending web sheets between slope sheets 76 and 78. The web sheets 80 distribute the vertical loads to the side walls 82 and 84. It would be appreciated by one of ordinary skill in the art that the particular web sheet design could be readily modified.

The trucks H are the standard trucks used on railway cars, i.e. trucks having double axles. However the trucks are uniformly spaced to evenly distribute the load exerted on the track structure.

Center sill I includes a plurality of rigid segments 86 secured to shear plates 88 (shown in FIG. 8). An articulated connector 90 is used to join rigid segments 86 to provide a swivel connection therebetween. The articulated connector 90 includes a male portion 92 connected to the female receiver 94. The female portion 94 is rotatably mounted on standard truck bolsters 95.

OPERATION OF THE SECOND EMBODIMENT

The operation of railway car F will be described with reference to a train consisting of a locomotive and a single railway car F. It will be appreciated by one of ordinary skill in the art that additional railway cars could be coupled to the train.

Railway car F having an optimal length of 500 feet is coupled to the locomotive by standard coupling elements 96. The drive force of the locomotive is transferred to the railway car via the center sill I and standard couplings 96. Three features of the railway car F allow it to maneuver varying terrain. These features are overlapping means J, slideable slope sheets 76 and 78 and the articulated connectors 90. Overlapping means J is identical to overlapping means E disclosed in the first embodiment of the invention. Similarly, slope sheets 76 and 78 function in the same manner as slope sheets 34 and 36. The articulated connectors 90 provide the necessary swivel connection between the rigid segments 82 and truck bolsters 94.

The railway car F having an ideal length of 500 feet eleminates intermediate coupling elements and end walls necessary for conventional railway cars having an equivalent trough length. The railway car F, therefore, significantly reduces the weight attributable to the railway car directly resulting in an increase in its load carrying capacity.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to the essential features set forth, and fall within the scope of the invention of the limits of the appended claims.

What is claimed is:

1. A railway car for carrying bulk commodities such as coal or the like; comprising:

(a) a body section including first and second end walls, first and second side walls and a floor, (b) said end walls, said side walls, and said floor forming one continuous trough, (c) first and second end wheel-containing truck means being positioned adjacent said first and second end walls respectively for supporting said body section, (d) at least first and second intermediate wheel-containing truck means being positioned between said first and second end wheel-containing truck means for supporting an intermediate portion of said body section, (e) a center sill extending longitudinally the length of said body section, (f) means for unloading said coal or the like from said body section, (g) means for supporting said side walls in an upright position, (h) said first and second side walls each including first and second end panels operably connected to said first and second end walls respectively and at least one intermediate panel positioned between said first and second panels, (i) said first intermediate wheel-containing truck means being positioned such that is overlaps at least a portion of said first panel and at least a portion of an intermediate panel, and (j) said second intermediate wheel-containing truck means being positioned such that it overlaps at least a portion of said second panel and at least a portion of an intermediate panel.

2. A railway car for carrying bulk commodities such as coal or the like as in claim 1, wherein:

(a) said wheel-containing truck means are single axlw trucks.

3. A railway car for carrying bulk commodities such as coal or the like as in claim 2, wherein:

(a) said single axle trucks are uniformly spaced along the body section for evenly distributing the load.

4. A railway car for carrying bulk commodities such as coal or the like as in claim 1, wherein:

(a) said wheel-containing truck means are double axle trucks.

5. A railway car for carrying bulk commodities such as coal or the like as in claim 4, wherein:

(a) said double axle trucks are uniformly spaced along said body section for evenly distributing the load.

6. A railway car for carrying bulk commodities such as coal or the like as in claim 1, wherein:

(a) said center sill is a compound center sill, said compound center sill includes an exterior member fixed to said body section, (b) a flexible continuous interior member supported by said exterior member in such a manner as to permit said interior member to move relative to said exterior member, and (c) said interior member having at least a first stop means for engaging said exterior member for limiting longitudinal relative movement therebetween.

7. A railway car for carrying bulk commodities such as coal or the like as in claim 6, wherein:

(a) a plurality of support members are disposed on at least one side of said exterior member and are fixed at one end to said exterior member and fixed to an adjacent side wall at an opposite end, for transferring the longitudinal load from said exterior member to said adjacent side wall.

8. A railway car for carrying bulk commodities such as coal or the like as in claim 6, wherein:

(a) a clearance is provided between each side of said interior member and each adjacent side of said exterior member, and (b) a non-metallic contact pad is positioned in said clearance for reducing electrolytic corrosion of said compound center sill.

9. A railway car for carrying bulk commodities such as coal or the like as in claim 6, wherein:

(a) said stop means include at least one rubber stop pad.

10. A railway car for carrying bulk commodities such as coal or the like as in claim 1, wherein:

(a) said center sill includes a plurality of rigid center sill segments secured to said body section, and (b) a plurality of articulated connectors for rotatably connecting adjacent center sill segments for manuvering curves.

11. A railway car for carrying bulk commodities such as coal or the like as in claim 1, wherein:

(a) said means for unloading said coal include a plurality of slope sheets, (b) said means for supporting said side walls include a plurality of support beams fixed at one end to one of said side walls and at the other end to one of said slope sheets.

12. A railway car as in claim 1, wherein:

(a) said side walls include means for permitting relative motion between said side panels.

13. A railway car for carrying bulk commodities such as coal or the like; comprising:

(a) a body section including first and second end walls, first and second side walls and a floor, (b) said body section being supported at each end wall by wheel-containing truck means and in an intermediate section by at least one wheel-containing truck means, (c) a single compound center sill including interior and exterior members, (d) said interior member extending longitudinally the length of said body section, (e) said exterior member being fixed to said body section and including means for supporting said interior member in such a manner as to permit said interior member to move relative to said exterior member, (f) said interior member being flexible for permitting said body section to maneuver through horizontal and vertical curves, (g) said interior member having at least a first stop means for limiting longitudinal relative motion between said interior member and said exterior member, (h) means for unloading said coal or the like from said body section, (i) means for supporting said side walls in an upright position, (j) said first and second side walls each including at least first and second panels, and (k) means operably associated with said first and second panels for permitting relative motion therebetween.

14. A railway car for carrying bulk commodities such as coal or the like as in claim 13, wherein:

(a) said wheel-containing truck means are single axle trucks uniformly spaced along said body section for evenly distributing the load.

15. A railway car for carrying bulk commodities such as coal or the like as in claim 13, wherein:

(a) said wheel-containing truck means are double axle trucks uniformly spaced along said body section for evenly distributing the load.

16. A railway car for carrying bulk commodities such as coal or the like as in claim 13, wherein:

(a) said side walls include an end panel abutting each end wall and a plurality of intermediate side panels, (b) said end panels and intermediate panels each having first and second edges, (c) said second end edges of said end panels abutt said end walls and said first end edges include overlapping means, and (d) said intermediate side panels each having overlapping means formed on said first and second end edges.

17. A railway car for carrying bulk commodities such as coal or the like as in claim 13, wherein:

(a) said means for unloading said coal include first and second slope sheets extending laterally across said body section, and (b) means for permitting relative movement between said first and second slope sheets.

18. A railway car for carrying bulk commodities such as coal or the like as in claim 17, wherein:

(a) said means for unloading said coal include at least first and second slope sheets extending longitudinally along said body section and abutting one of said first and second transversely extending slope sheets.

19. A railway car as in claim 13, wherein:

(a) said exterior member of said compound center sill includes a plurality of section intermittently spaced along said interior member.

20. A compound center sill for a railway car and the like; comprising:

(a) an interior member extending longitudinally substantially the length of the railway car, (b) an exterior member fixed to the railway car;

(c) said interior member being flexible for permitting said interior member to bend to substantially conform to horizontal and vertical curves encountered by the railway car manuevering through undulating terrain, (d) said exterior member including a plurality of sections intermittently spaced along the interior member for preventing buckling of said interior member, (e) at least a first stop means fixed to said interior member for engaging said sections for transferring a longitudinal force to the railway car, and (f) a clearance being provided between said interior therebetween and said exterior member for permitting relative motion therebetween.

21. A compound center sill as in claim 20, wherein:

(a) a non-metallic contact pad is positioned in said clearance for reducing electrolytic corrosion of the compound center sill.

* * * * *